US006676010B1

(12) United States Patent
Roseth et al.

(10) Patent No.: US 6,676,010 B1
(45) Date of Patent: Jan. 13, 2004

(54) RECLOSABLE FOOD CONTAINER

(75) Inventors: Steven H. Roseth, Fresno, CA (US); Gerald Pfieffer, Seattle, WA (US)

(73) Assignee: MasterCraft Packaging Corporation, Fresno, CA (US)

( * ) Notice: Subject to any disclaimer, the term of this patent is extended or adjusted under 35 U.S.C. 154(b) by 0 days.

(21) Appl. No.: 10/246,390

(22) Filed: Sep. 18, 2002

(51) Int. Cl.[7] ..... B65D 5/24

(52) U.S. Cl. ..... 229/114; 229/148; 229/149; 229/186; 229/930; 229/931

(58) Field of Search ..... 229/114, 148, 229/149, 186, 902, 903, 911, 930, 931

(56) References Cited

U.S. PATENT DOCUMENTS

| | | | | | |
|---|---|---|---|---|---|
| 205,531 | A | | 7/1878 | Donahue | |
| 1,681,940 | A | * | 8/1928 | Lander | 229/114 |
| 1,694,126 | A | | 12/1928 | Joslin | |
| 2,173,927 | A | * | 9/1939 | Allen | 229/931 |
| 2,447,563 | A | | 8/1948 | Buttery | |
| 2,469,343 | A | | 5/1949 | Siewert | |
| 2,492,454 | A | * | 12/1949 | Anderson, Jr. | 229/148 |
| 2,565,288 | A | | 8/1951 | Worfford | |
| 2,650,751 | A | | 9/1953 | Goers | |
| 2,675,163 | A | | 4/1954 | Buttery | |
| 2,675,164 | A | | 4/1954 | Haas | |
| 2,846,132 | A | * | 8/1958 | Carpenter | 229/149 |
| 2,957,617 | A | | 10/1960 | Bolding | |
| 3,146,933 | A | * | 9/1964 | Moore | 229/186 |
| 3,191,845 | A | | 6/1965 | Wainberg | |
| 3,258,191 | A | * | 6/1966 | Mueller et al. | 229/186 |
| 3,362,527 | A | | 1/1968 | Watson | |
| 3,627,641 | A | * | 12/1971 | Farquhar | 229/186 |
| RE27,870 | E | | 1/1974 | Persson | |
| D244,833 | S | | 6/1977 | Persson | |
| 4,214,695 | A | | 7/1980 | Cooper | |
| 4,403,729 | A | | 9/1983 | Wytko | |
| 4,451,001 | A | | 5/1984 | Webinger | |
| 4,836,438 | A | * | 6/1989 | Rigby | 229/903 |
| 4,930,639 | A | | 6/1990 | Rigby | |
| 4,930,681 | A | | 6/1990 | Fultz et al. | |
| 5,209,392 | A | * | 5/1993 | Anatro | 229/931 |
| 5,326,022 | A | | 7/1994 | Green | |
| 5,553,772 | A | | 9/1996 | Jensen | |
| 5,779,135 | A | | 7/1998 | Richardson | |
| 5,791,554 | A | | 8/1998 | Jensen | |
| 5,839,652 | A | | 11/1998 | Ben-Haim | |
| 5,855,315 | A | | 1/1999 | Roseth | |
| 6,223,979 | B1 | | 5/2001 | Correll | |

* cited by examiner

*Primary Examiner*—Gary E. Elkins
(74) *Attorney, Agent, or Firm*—Blakely, Sokoloff, Taylor & Zafman LLP

(57) ABSTRACT

A reclosable food container is created from a unitary blank. The container includes a bottom panel, a pair of opposing end panels extending from the first bottom panel, a lateral side panel extending from the first bottom panel, and an opposing side panel extending from the bottom panel on an opposing side to the lateral side panel. The container also includes a plurality of foldable gussets, where each gusset hingedly connects a side panel-end panel pair. The container also includes a lid extending from the lateral side panel, where the lid includes a top panel and a tuck flap. There is a score line between at least one of the lateral side panel and the top panel, and the top panel and the tuck flap. The score line has a ratio of penetration between about 0.1 and about 0.9.

14 Claims, 5 Drawing Sheets

RECLOSABLE FOOD CONTAINER

BACKGROUND

1. Field

A reclosable food container suitable for use in the take-out food industry. More particularly, an easily openable and reclosable food container having a cavity which is erected from a single unitary blank.

2. Relevant Art

The expansion of the take-out and prepared food industry over the last several years has increased demand for suitable containers. The Chinese food pail is well-known in the take-out food industry. It is preconstructed at the manufacture plant by folding the pre-cut blank and fastening the gussets with glue or metallic wire. This simplifies use by the food seller who need merely fill the container and close the lid. These Chinese food pails typically have a deep narrow configuration which makes them unsuitable for storage of food not intended to intermingle. Moreover, such pails uniformly have a four-panel lid structure which requires four different folding operations and the use of both hands to achieve closure.

Another type of food carton is fashioned in a shallower configuration. The same four-fold lid structure is also employed by this type of container.

Still another type of food container is fashioned in the form of an open tray for storing a predetermined amount of food. It is erected at the point of purchase from a pre-cut, pre-scored carton blank. These blanks are typically erected by manually performing numerous time consuming folding and tucking operations at the point of sale. The resulting container often leaks at the corner formed by interlocking tabs and slots. Some variations employ glue to secure the adjacent panels, but leaking remains a problem. Such containers are unsatisfactory for packaging many prepared or take-out foods.

In view of the foregoing, it would be desirable to have a reclosable food container with a simplified lid closure.

SUMMARY

A reclosable food container is created from a unitary blank. The container includes a bottom panel, a pair of opposing end panels extending from the first bottom panel, a lateral side panel extending from the first bottom panel, and an opposing side panel extending from the bottom panel on an opposing side to the lateral side panel. The container also includes a plurality of foldable gussets, where each gusset hingedly connects a side panel-end panel pair. The container also includes a lid extending from the lateral side panel, where the lid includes a top panel and a tuck flap. There is a score line between at least one of the lateral side panel and the top panel, and the top panel and the tuck flap. The score line has a ratio of penetration between about 0.1 and about 0.9.

A method of making a reclosable food container from a unitary blank includes scoring the unitary blank with a plurality of score lines and a plurality of fold lines. At least two of the score lines define a top panel and a tuck flap of a lid. The score lines have a ratio of penetration between about 0.1 and about 0.9. The method also includes folding along two pairs of substantially parallel fold lines that define a bottom panel. The method also includes folding along four sets of fold lines, each set defining a gusset extending between pairs of adjacent walls of a cavity, and adhering each gusset to an outer surface of one of the adjacent walls. The lid extends from a wall of the cavity.

DETAILED DESCRIPTION

Figure 1:
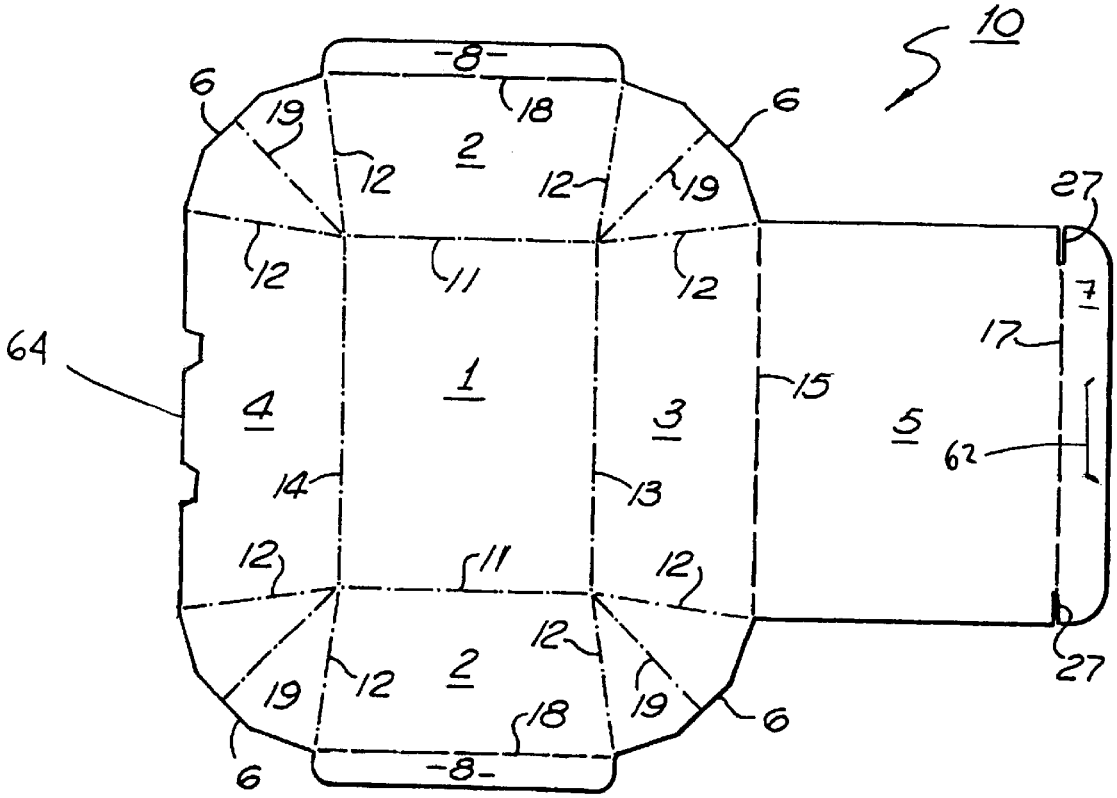
FIG. 1 is a blank of a food container of a first embodiment.

FIG. 1 shows blank 10 of a food container of a first embodiment. Blank 10 from which a container may be formed may be punched as a unitary blank from a single sheet of paperboard material suitable for holding, heating, and cooking food. Any paperboard which can withstand the heat generated by a microwave or convection oven is suitable. Suitable paperboard is commercially available and well known in the trade. In one embodiment, paperboard may be coated and/or laminated with a material (for example a polymer) so that the container can hold liquids.

Blank 10 has substantially rectangular bottom panel 1 which is defined by first pair of substantially parallel fold lines 11 and second pair of substantially parallel fold lines 13, 14. Pair of end panels 2 extend from first bottom panel 1 along fold lines 11. Pair of splash guard flaps 8 extend from pair of end panels 2 along score lines 18. First lateral side panel 3 extends from first bottom panel 1 along fold line 13. Upper edge of first lateral side panel 3 is defined by score line 15. A lid that includes top panel 5 and tuck flap 7 extends therefrom. Score line 17 delineates the transition between top panel 5 and tuck flap 7. Score line 17 terminates at either end in locking slits 27. Flap 7 also includes locking slot mechanism 62.

Opposing side panel 4 extends from first bottom panel 1 along fold line 14. Opposing side panel 4 includes locking tab mechanism 64.

Generically, end panels 2, lateral side panel 3, and opposing side panel 4 are referred to as walls, four gussets 6 extending between adjacent pairs of walls (side-end pairs). Each gusset 6 is defined by a pair of wall edge defining fold lines 12 and at least one interior fold line 19. By appropriately folding along the fold line, a cavity having a lid is defined.

In one embodiment, blank 10 is punched and primarily assembled (e.g., gussets glued) at a manufacturing facility prior to shipment to an end user.

Figure 2:
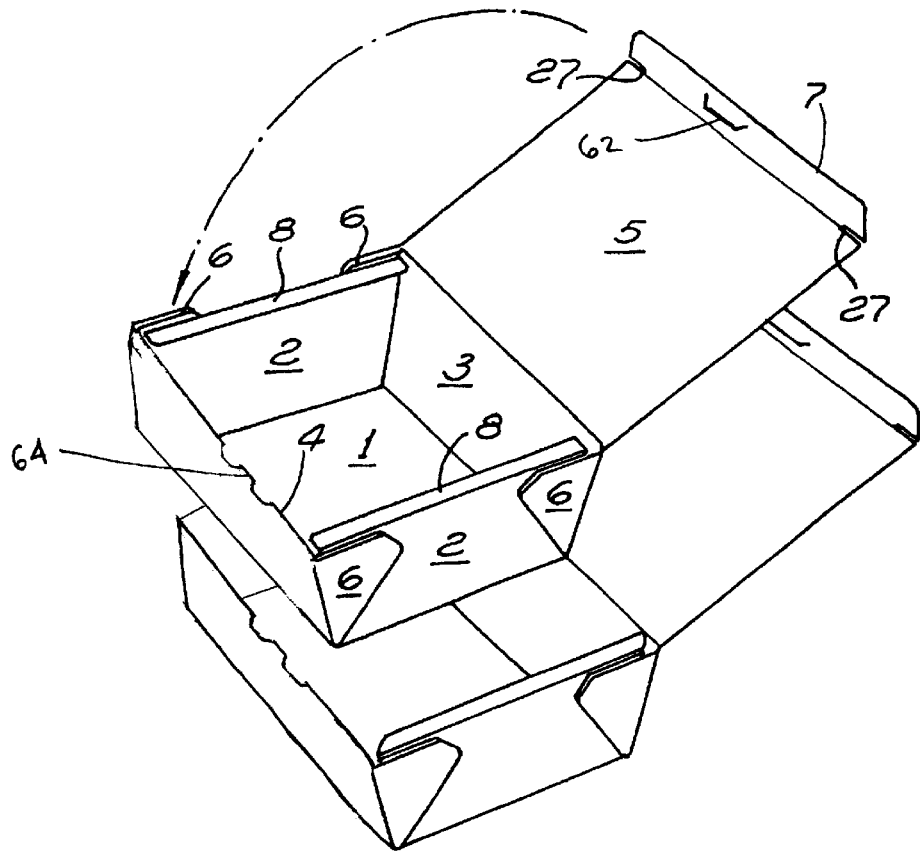
FIG. 2 is a food container assembled from the blank shown in FIG. 1 nested with a second food container.

FIG. 2 shows a container assembled from blank 10 shown in FIG. 1. Gussets 6 are folded and adhered to end panels 2. When the lid, e.g., including top panel 5 and tuck flap 7, is moved to a closed orientation, tuck flap 7 frictionally engages at least one of opposing side panel 4 and/or pair of end panels 2. Locking slits 27 may also engage splash guard flaps 8. In addition, locking tab mechanism 64 may slidingly engage with locking slot mechanism 62. One or more of these engagements act to maintain closure so that food placed within the cavity will be retained.

The fact that the cavity is formed from a contiguous sheet prevents leaking at the gussets 6 as long as a substantially upright orientation is maintained.

In one embodiment, one or more walls of the cavity are trapezoidal. Thus, end panels 2, lateral side panel 3, and/or opposing side panel 4 slope downward from their upper edges to their intersection with bottom panel 1. In another embodiment, score lines 18 are longer than fold lines 11. This permits the assembled containers to be nested for shipping and storage so as to require less space during such shipping and storage.

Once blank 10 is punched from a suitable paperboard sheet and appropriately scored, to assemble the container of a first embodiment, end panels 2, lateral side panel 3, and opposing side panel 4 are folded upward along fold lines 11, 13, and 14 such that end panels 2, lateral side panel 3, and opposing side panel 4 define a cavity with bottom panel 1.

Gussets 6 are folded along fold line 19 such that each gusset 6 extends outward from a defined cavity. Each gusset 6 is then folded to be adjacent to an external surface of end panels 2 and may be attached thereto, in one embodiment, with a suitable adhesive. It is also contemplated that gussets 6 may be adhered to the external surface of side panels 3, 4. Suitable adhesives are well-known in the art.

Splash guard flaps 8 are folded inward so as to extend over a portion of the cavity defined by end panels 2, lateral side panel 3, and opposing side panel 4 (walls 2–4) and bottom panel 1. Score line 17 may be creased so that when top panel 5 is folded along score line 15, tuck flap 7 is positioned to engage opposing side panel 4.

Figure 3:
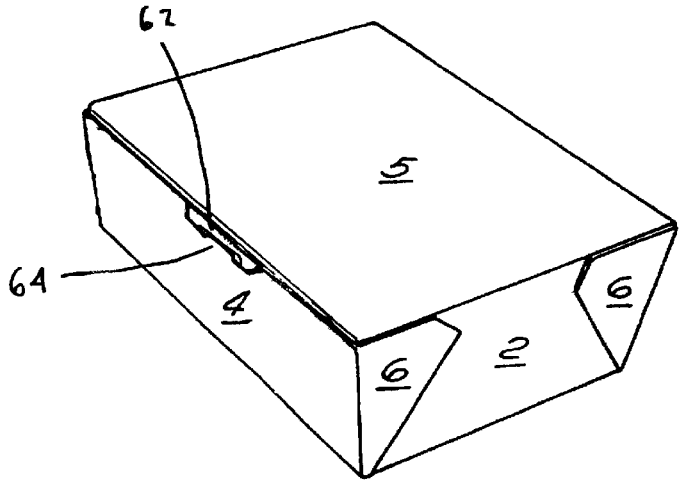
FIG. 3 shows a food container of one embodiment with the top closed.

FIG. 3 shows a container assembled from blank 10 of FIG. 1 with the lid, including top panel 5 and tuck flap 7, moved to a closed orientation. Tuck flap 7 frictionally engages at least one of opposing side panel 4 and/or pair of end panels 2. Locking slits 27 may also engage splash guard flaps 8. In addition, locking tab mechanism 64 is shown slidingly engaged with locking slot mechanism 62.

Figure 4:
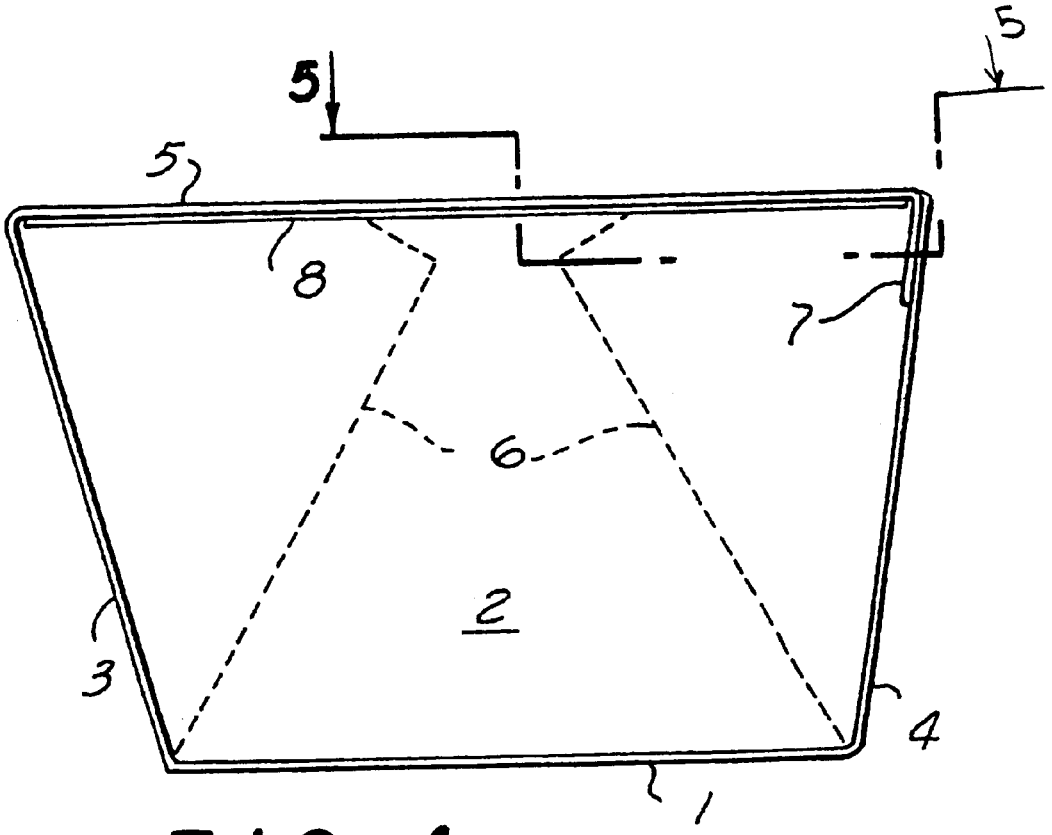
FIG. 4 shows a sectional view of a container of FIG. 2 with gussets in phantom view.

FIG. 4 shows a sectional view of the container of FIG. 3. In this view, the frictional engagement between tuck flap 7 and opposing side 4 is shown. Gussets 6 are shown in phantom view.

Figure 5:
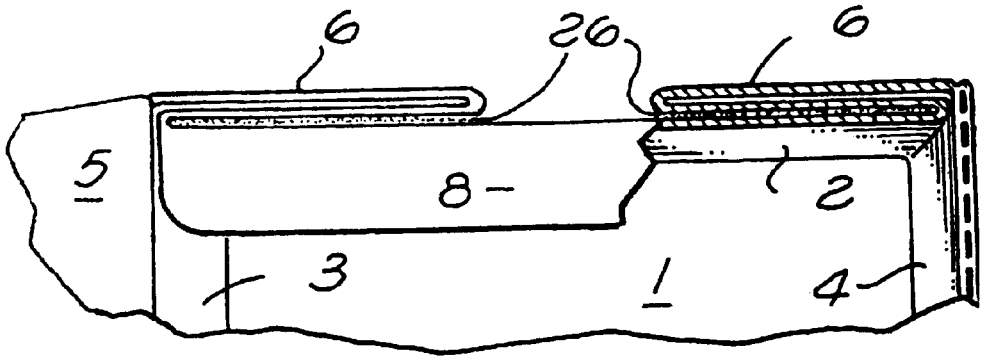
FIG. 5 shows a partial sectional view of the container of FIG. 4.

FIG. 5 shows a partial sectional view of the container of FIG. 4 along line 5—5 in which gussets 6 are shown adhered to end panel 2 by adhesive 26. In one embodiment, adhesive 26 does not degrade when reheated, e.g., a microwave oven. Suitable adhesives are well known in the art.

Figure 6:
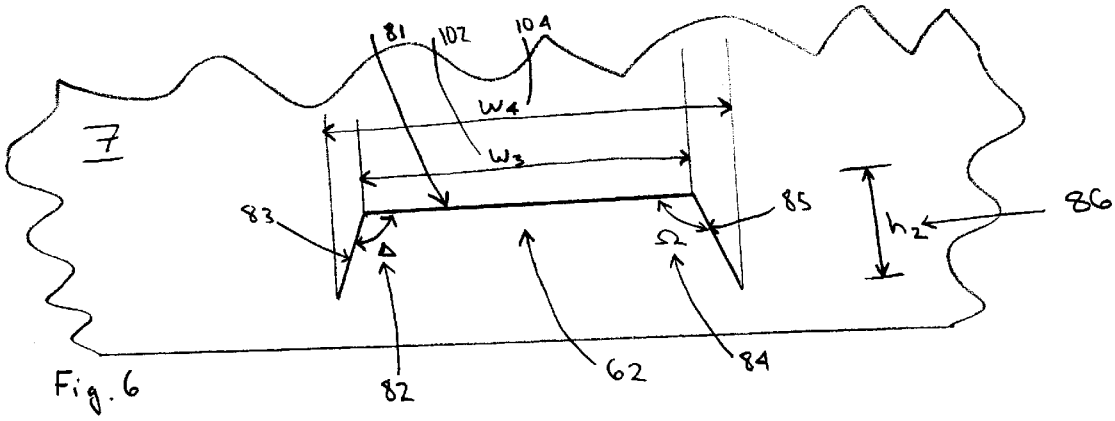
FIG. 6 shows a portion of the tuck flap.

FIG. 6 illustrates a portion of tuck flap 7 with locking slot mechanism 62. Locking slot mechanism 62 includes horizontal portion 81 and two downward portions 83, 85. Horizontal portion 81 makes angle Δ82 with downward portion 83. Horizontal portion 81 makes angle Ω84 with downward portion 85. Horizontal portion 81 has top width W3 102. Locking slot mechanism 62 has total width W4 104 which includes horizontal portion 81 and downward portions 83, 85. Locking slot mechanism 62 has height H2 86.

In one embodiment, top width W3 102 is between about 0.25 and about 2.5 inches. In another embodiment, top width W3 102 is between about 0.5 and about 2.0 inches. In another embodiment, top width W3 102 is about 1.5 inches.

In one embodiment, total width W4 104 is between about 0.25 and about 2.5 inches. In another embodiment, total width W4 104 is between about 0.5 and about 2.0 inches. In another embodiment, total width W4 103 is about 1.5 inches.

In one embodiment, the ratio of top width W3 102 to total width W4 104 is between about 0.5 and about 1.0. In another embodiment, the ratio of top width W3 102 to total width W4 104 is between about 0.75 and about 1.0. In another embodiment, the ratio between top width W3 102 and total width W4 104 is about 1.0.

In one embodiment, angle Δ82 is between about 60° and about 120°. In another embodiment, angle Δ82 is between about 75° and about 105°. In another embodiment, angle Δ82 is about 90°.

In one embodiment, angle Ω84 is between about 60° and about 120°. In another embodiment, angle Ω84 is between about 75° and about 105°. In another embodiment, angle Ω84 is about 90°.

In one embodiment, height H2 is between about 0.1 and about 1.0 inches. In another embodiment, height H2 86 is between about 0.15 and about 0.5 inches. In another embodiment, height H2 is about 0.25 inches.

Figure 7:
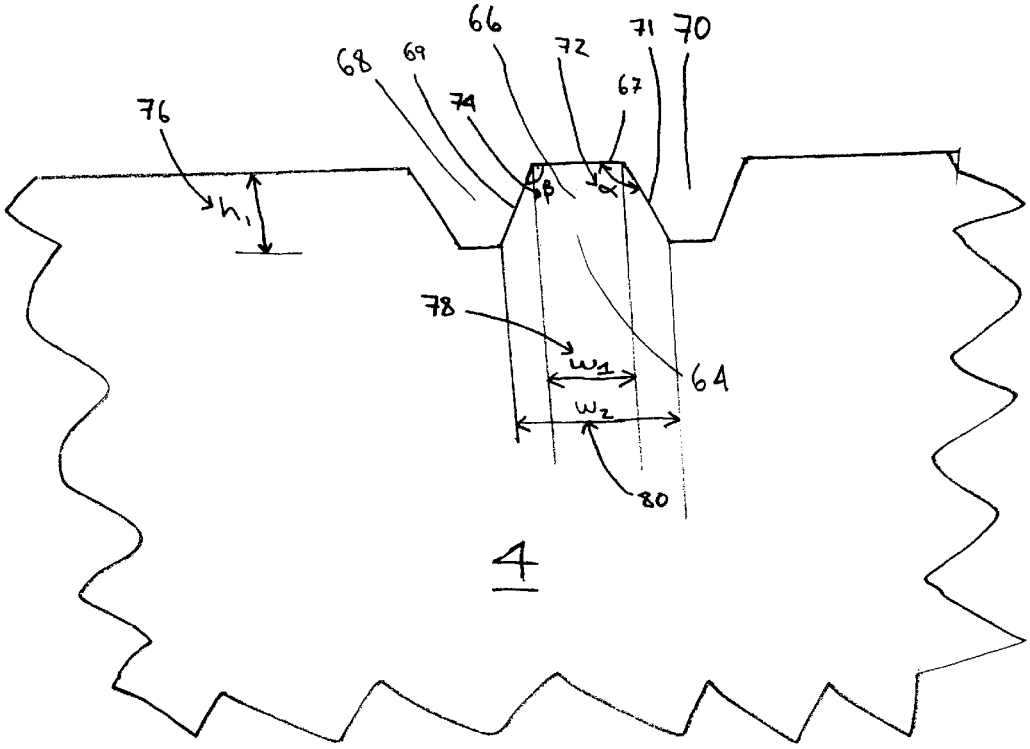
FIG. 7 shows a portion of the opposing side panel.

FIG. 7 illustrates a portion of opposing side panel 4 with locking tab mechanism 64. Locking tab mechanism 64 includes horizontal portion 67 and downward portions 69 and 71. On either side of tab portion 66 are two indentations 68, 70. Tab portion 66 has angle β74 between horizontal portion 67 and downward portion 69. Tab portion 66 has angle α72 between horizontal portion 67 and downward portion 71. In one embodiment, tab portion 66 has a trapezoidal shape.

Tab portion 66 has height H1 76. Tab portion 66 has width W1 78 at the top, along horizontal portion 67, and width W2 80 (that includes horizontal portion 67 and downward portions 69, 71) at the bottom.

In one embodiment, top width W1 78 is between about 0.25 and about 2.0 inches. In another embodiment, top width W1 78 between about 0.5 and about 2.0 inches. In another embodiment, top width W1 78 is about 1.25 inches.

In one embodiment, bottom width W2 80 is between about 0.25 and about 2.5 inches. In another embodiment, bottom width W2 80 is between about 0.5 and about 2.0 inches. In another embodiment, bottom width W2 80 is about 1.5 inches.

In one embodiment, angle β74 is between about 90° and about 150°. In another embodiment, angle β74 is between about 100° and about 140°. In another embodiment, angle β74 is about 120°.

In one embodiment, angle β72 is between about 90° and about 150°. In another embodiment, angle α72 is between about 100° and about 140°. In another embodiment, angle α72 is about 120°.

In another embodiment, the ratio between top width W1 78 and bottom width W2 80 is between about 0.5 and about 1.0. In another embodiment, the ratio between top width W1 78 and bottom width W2 80 is between about 0.6 and about 0.9. In another embodiment, the ratio between top width W1 78 and bottom width W2 80 is about 0.75.

In one embodiment, locking slot mechanism 62 and locking tab mechanism 64 can be engaged with each other with one hand when closing the food container. In another embodiment, locking slot mechanism 62 and locking tab mechanism 64 can be disengaged from each other when opening the food container. In another embodiment, locking slot mechanism 62 and locking tab mechanism 64 can be engaged with each other with a single finger when closing the food container. In another embodiment, locking slot mechanism 62 and locking tab mechanism 64 can be disengaged from each other with a single finger when opening the food container.

Figure 8:
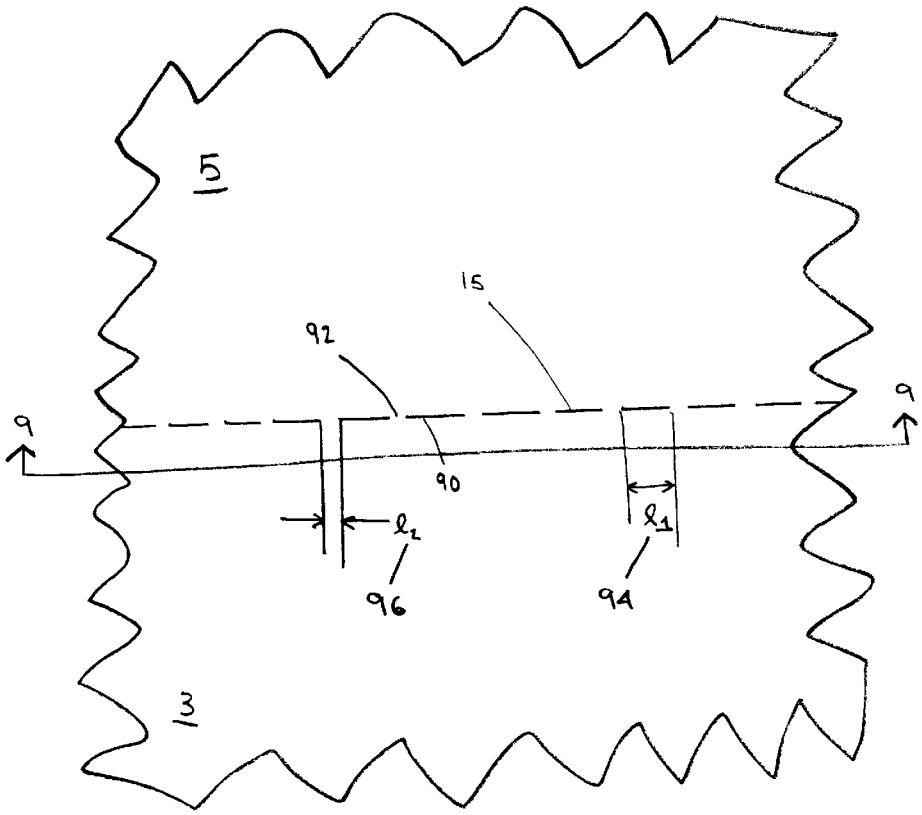
FIG. 8 shows a section of the score line between the side panel and the top panel.

FIG. 8 illustrates a section of score line 15 between side panel 3 and top panel 5. Score line 15 includes a configuration having scored portions 90 and unscored portions 92. Scored portions 90 have length L1 94. Unscored portions 92 have a length L2 96.

In one embodiment, length L1 94 is between about 0.1 and about 2.0 inches. In another embodiment, length L1 94 is between about 0.2 and about 1.5 inches. In another embodiment, length L1 94 is between about 0.5 and about 1.25 inches. In another embodiment, length L1 94 is about 1.0 inches.

In one embodiment, length L2 96 is between about 0.01 and about 0.5 inches. In another embodiment, length L2 96 is between about 0.05 and about 0.3 inches. In another embodiment, length L2 96 is between about 0.1 and about 0.25 inches. In another embodiment, length L2 96 is about 0.2 inches.

Figure 9:
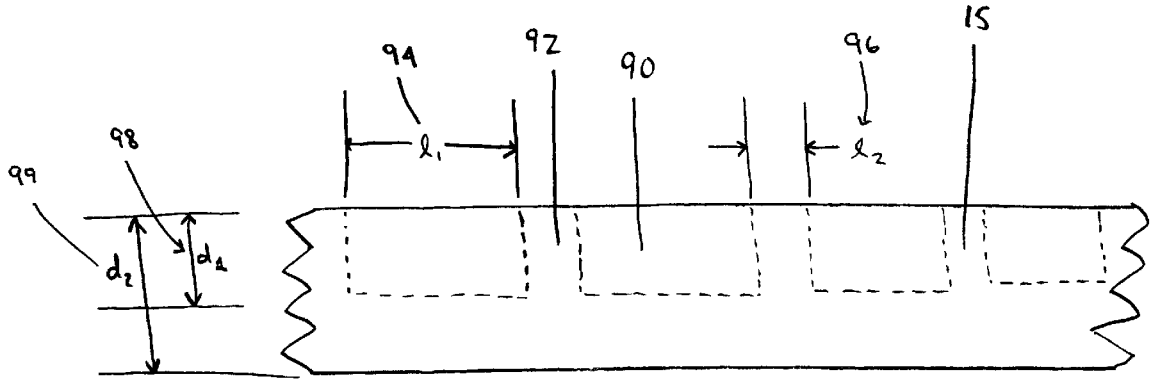
FIG. 9 shows a sectional view of the score line along the line 9—9 of FIG. 8.

FIG. 9 shows a sectional view along the line 9—9 of FIG. 8. FIG. 9 shows a portion of score line 15 with scored portions 90 and unscored portions 92. Scored portions 90 have length L1 94. Unscored portions 92 have length L2 96. Scored portions 90 have depth of scoring D1 98. The paperboard has thickness D2 99. The ratio of penetration is defined as the ratio of depth of scoring D1 98 divided by thickness of the paperboard D2 99.

In one embodiment, the ratio of penetration of score line 15 is between about 0.1 and about 0.9. In another embodiment, the ratio of penetration of score line 15 is between about 0.2 and about 0.8. In another embodiment, the ratio of penetration of score line 15 is between about 0.3 and about 0.7. In another embodiment, the ratio of penetration of score line 15 is between about 0.45 and about 0.55. In another embodiment, the ratio of penetration of score line 15 is about 0.5.

While FIGS. 8 and 9 illustrate score line 15 between side panel 3 and top panel 5, the discussion of FIGS. 8 and 9 is also applicable to score lines 17 and 18.

In one embodiment, score line 17 has a ratio of penetration the same as or similar to score line 15. In another embodiment, score line 17 has a different ratio of penetration than score line 15, but score line 17 meets one or more of the parameters discussed above for score line 15.

In one embodiment, score line 18 has a ratio of penetration the same as or similar to score line 15 and/or score line 17. In another embodiment, score line 18 has a different ratio of penetration than score line 15 and/or score line 17, but score line 18 meets one or more of the parameters discussed above for score line 15.

In one embodiment, fold lines 11, 12, 13, 14, and 19 have ratio of penetration less than score lines 15, 17, and 18.

In one embodiment, fold lines 11, 12, 13, 14, and 19 have a ratio of penetration between about 0.0 and about 0.4. In another embodiment, fold lines 11, 12, 13, 14, and 19 have a ratio of penetration between about 0.01 and about 0.2. In another embodiment, fold lines 11, 12, 13, 14, and 19 have a ratio of penetration of about 0.05.

In one embodiment, fold lines 11, 12, 13, 14, and 19 may have a lower ratio of penetration since the fold lines define the container, and are not used to open or close the lid of the container. In one embodiment, score lines 15, 17, and 18 may have a higher ratio of penetration than fold lines, since score lines 15, 17, and 18 are used in the operation of opening and closing the lid of the container.

In one embodiment, score line 15 has a ratio of penetration less than about 1.0, so that there is a lessened likelihood of leakage through score line 15. In another embodiment, score line 17 has a ratio of penetration less than about 1.0, so that there is a lessened likelihood of leakage through score line 17. In one embodiment, score line 15 has a ratio of penetration that makes closing and opening the lid easier. In another embodiment, score line 15 has a ratio of penetration so that the lid folds flatter than when in a closed orientation. In another embodiment, score line 15 has a ratio of penetration so that the lid has a flat shape rather than a bowed shape.

In another embodiment, fold lines 11, 12, 13, 14, and 19 and score lines 15, 17, and 18 have a ratio of penetration so that the reclosable food container has a cleaner look. In another embodiment, fold lines 11, 12, 13, 14, and 19 and score lines 15, 17, and 18 have a ratio of penetration so that the food container is more esthetically pleasing. In another embodiment, fold lines 11, 12, 13, 14, and 19 and score lines 15, 17, and 18 have a ratio of penetration so that the food container has a stronger structure. In another embodiment, locking slot mechanism 62 and locking tab mechanism 64 engage when the lid is in a closed orientation so that the food container has a stronger structure. In another embodiment, fold lines 11, 12, 13, 14, and 19 and score lines 15, 17, and 18 have a ratio of penetration, and locking slot mechanism 62 and locking tab mechanism 64 engage when the lid is in a closed orientation so that the food container has a stronger structure.

In one embodiment, a reclosable food container is created from unitary blank 10. The container includes bottom panel 1, pair of opposing end panels 2 extending from bottom panel 1, lateral side panel 3 extending from bottom panel 1, opposing side panel 4 extending from bottom panel 1 on an opposing side to lateral side panel 3. Opposing side panel 4 includes locking tab mechanism 64. The container also includes a plurality of foldable gussets 6, each gusset 6 hingedly connecting a side panel-end panel pair. The container also includes a lid extending from lateral side panel 3. The lid includes top panel 5 and tuck flap 7. Tuck flap 7 includes locking slot mechanism 62. The lid engages at least one of opposing side 4, pair of opposing end panels 2, and locking tab mechanism 64 when in a closed orientation. The container also includes score line 15 (between lateral side panel 3 and top panel 5) or score line 17 (between top panel 5 and tuck flap 7), where score line 15 and/or 17 has a ratio of penetration between about 0.2 and about 0.8.

In another embodiment, each opposing end panel 2 of the food container also includes splash guard flap 8 extending therefrom.

In another embodiment, tuck flap 7 of the lid of the food container engages splash guard flaps 8 when the lid is in a closed orientation.

In another embodiment, the reclosable food container also includes pair of locking slits 27 formed at opposite edges of a junction between top panel 5 and tuck flap 7, where locking slits 27 increase a retention strength of the engagement between respective opposing splash guard flaps 8 when the lid is in a closed orientation. In another embodiment, side panels 3, 4 and end panels 2 of the food slope upward at a predetermined angle from bottom panel 1 so that a pair of food containers are nestable one within the other.

In another embodiment, respective ones of panels 1, 2, 3, and/or 4 of the food container are defined on blank 10 by fold lines 11, 12, 13, 14, and/or 19. In another embodiment, score lines 15, 17, and/or 18 of the food container have a ratio of penetration between about 0.3 and about 0.7.

In another embodiment, score lines 15, 17, and/or 18 of the food container have a ratio of penetration between about 0.45 and about 0.55.

In another embodiment, score lines 15, 17, and/or 18 of the food container have a ratio of penetration of about 0.5.

In another embodiment, score lines 15, 17, and/or 18 of the food container have a ratio of length 96 of unscored portion 92 to length 94 of scored portion 90 between about 0.1 and about 0.5.

In another embodiment, score lines 15, 17, and/or 18 of the food container have a ratio of length 96 of unscored portion 92 to length 94 of scored portion 90 between about 0.15 and about 0.25.

In another embodiment, score lines 15, 17, and/or 18 of the food container have a ratio of length 96 of unscored portion 92 to length 94 of scored portion 90 of about 0.2.

In one embodiment, a method of making a reclosable food container from unitary blank 10 includes scoring unitary blank 10 with a plurality of score lines 15, 17, and/or 18 and a plurality of fold lines 11, 12, 13, 14, and/or 19. At least two of score lines 15, 17, and/or 18 define top panel 5 and tuck flap 7 of a lid. Score lines 15, 17, and/or 18 have a ratio of penetration between about 0.2 and about 0.8. The method also includes folding along two pairs of substantially parallel fold lines 11, 13, 14 that define bottom panel 1. The method also includes folding along four sets of fold lines 12 and/or 19, each set 12 and/or 19 defining gusset 6 extending between pairs of adjacent walls 2-3 or 2-4 of a cavity. The method also includes adhering each gusset 6 to an outer surface of one of the adjacent walls 2, 3, and/or 4. The lid extends from wall 3 of the cavity so as to permit engagement of at least one of opposing wall 4 and locking tab mechanism 64 if folded about score lines 15, 17 that define the lid.

In another embodiment, the container of the method also includes locking slits 27 at a junction between tuck flap 7 and top panel 5 of the lid, and the method also includes engaging pair of splash guard panels 8 with locking slits 27.

In the foregoing specification, the container has been described with reference to specific embodiments thereof. It will, however, be evident that various modifications and changes can be made thereto without departing from the broader spirit and scope as set forth in the appended claims. The specification and drawings are, accordingly, to be regarded in an illustrative rather than a restrictive sense. Therefore, the scope should be limited only by the appended claims.

What is claimed is:

1. A reclosable food container created from a unitary blank, the container comprising:

a bottom panel;

a pair of opposing end panels extending from the bottom panel;

a lateral side panel extending from the bottom panel;

an opposing side panel extending from the bottom panel on an opposing side to the lateral side panel;

a plurality of foldable gussets, each gusset hingedly connecting a side panel-end panel pair;

a lid extending from the lateral side panel, the lid comprising a top panel and a tuck flap;

a score line between at least one of the lateral side panel and the top panel, and the top panel and the tuck flap, wherein the score line has a ratio of penetration between about 0.1 and about 0.9.

2. The food container of claim 1 wherein each opposing end panel further comprises a splash guard flap extending therefrom.

3. The food container of claim 2 wherein the tuck flap of the lid engages the splash guard flaps when the lid is in a dosed orientation.

4. The reclosable food container of claim 3 further comprising:

a pair of locking slits formed at opposite edges of a junction between the top panel and the tuck flap;

wherein the locking slits increase a retention strength of the engagement between the respective opposing splash guard flaps when the lid is in a closed orientation.

5. The food container of claim 1 wherein the side panels and end panels slope upward at a predetermined angle from the bottom panel such that a pair of food containers are nestable one within another.

6. The food container of claim 1 wherein respective ones of the panels are defined on the blank by fold lines.

7. The food container of claim 1 wherein the score line has a ratio of penetration between about 0.3 and about 0.7.

8. The food container of claim 1 wherein the score line has a ratio of penetration between about 0.45 and about 0.55.

9. The food container of claim 1 wherein the score line has a ratio of penetration about 0.5.

10. The food container of claim 1 wherein the score line has a ratio of a length between an unscored portion and a scored portion between about 0.1 and about 0.5.

11. The food container of claim 1 wherein the score line has a ratio of a length between an unscored portion and a scored portion between about 0.15 and about 0.25.

12. The food container of claim 1 wherein the score line has a ratio of a length between an unscored portion and a scored portion of about 0.2.

13. The food container of claim 1, wherein the opposing side panel further comprises a locking tab mechanism, and the tuck flap further comprises a locking slot mechanism.

14. The food container of claim 13, wherein the lid engages at least one of the opposing side, the pair of opposing hinge panels, and the locking tab mechanism when in a closed orientation.

* * * * *

UNITED STATES PATENT AND TRADEMARK OFFICE

CERTIFICATE OF CORRECTION

PATENT NO. : 6,676,010 B1
DATED : January 13, 2004
INVENTOR(S) : Roseth et al.

It is certified that error appears in the above-identified patent and that said Letters Patent is hereby corrected as shown below:

Title page,
Item [56], References Cited, U.S. PATENT DOCUMENTS, 12/1971, please delete "3,627,641" and insert -- 3,627,541 --.

Signed and Sealed this

Tenth Day of August, 2004

JON W. DUDAS
*Acting Director of the United States Patent and Trademark Office*